US005814744A

United States Patent [19]

Hoke, Jr.

[11] Patent Number: 5,814,744

[45] Date of Patent: Sep. 29, 1998

[54] ENHANCEMENT OF ACOUSTIC MUSICAL INSTRUMENTS

[76] Inventor: Clare L. Hoke, Jr., 1318 N. Monte Vista Ave. Suite 11, Upland, Calif. 91786

[21] Appl. No.: 583,304

[22] Filed: Jan. 5, 1996

[51] Int. Cl.[6] ..... G10D 1/00; G10D 3/00

[52] U.S. Cl. ..... 84/291; 84/293; 84/267

[58] Field of Search ..... 84/291, 293, 294, 84/267

[56] References Cited

U.S. PATENT DOCUMENTS 3,302,507 2/1967 Fender ..... 84/267

4,295,403 10/1981 Harris ..... 84/293

*Primary Examiner*—William M. Shoop, Jr.

*Assistant Examiner*—Marlon T. Fletcher

[57] ABSTRACT

An acoustical musical instrument wherein traditionally required structural considerations are removed from the instruments vibrational plates. The structure of the instrument also increasing acoustic range and amplitude, and minimizing sound losses from dampening and frequency cancellations, by more accurately transferring vibrations within the instrument.

6 Claims, 3 Drawing Sheets

ENHANCEMENT OF ACOUSTIC MUSICAL INSTRUMENTS

BACKGROUND OF THE INVENTION

1. Field of the Invention

This invention relates to musical instruments, specifically to the bodies of acoustic musical instruments.

2. Description of Prior Art

The art of musical instrument manufacturing has a long tradition that is seldom questioned in regard to acoustic instruments. Orchestral instruments, like the violin, viola, cello and double bass all stem from the same pattern. These instruments vary from a basic design only in string scale length; to cover different musical ranges. These instruments consist of a head stock to house string tuning mechanisms, a short neck to give room for a large acoustical body, a finger board where the performer may act upon the strings and which must be cantilevered over the body of the instrument so as not to dampen the vibrations of the top plate of the body, a bridge over which the strings rest and are intonated for scale length, and a trapeze section where the strings reach their terminus at the end of the body. The body of the instrument is a box like arrangement with thicker sides and a top and bottom plate. The top and bottom plates of the instrument must have internal braces to give the plates enough structural integrity to resist the physical pressures of service. These pressures include the tensions of the strings, the energies of the player, the forces of vibrating in a sympathetic manner without falling apart, and internal stresses associated with the expansion and contraction of wood. Most of the musical resonance of an acoustic instrument comes as the result of the top and back plate vibrating in a manner to reinforce the audio amplitude of the strings vibrations.

Though well accepted, traditional acoustic instruments suffer flaws in design. Modern acoustic instruments have attempted structural improvements, such as making the sound hole asymmetrical (Ferrington), changing the shape of the back plate (Ovation), and metal bridge pin transfer bars (Breedlove). Deficiencies still suffered include the problems of short necks (so that fret board does not dampen the vibrations of the top plate), and internal braces which dampen the vibrations of the instrument, and generally diminish the transference of sound.

It is now well known that integral phase cancellations can be as acoustically damaging as dampening from structural members of an instrument. Often times the phased counter energies of an instruments structures are either neglected or accepted as a best compromise.

SUMMARY OF THE INVENTION

The present invention is an improvement over prior works in the art of acoustics. The invention produces greater amplitude by the elimination of losses from dampening and phase cancellations common to the accepted art of acoustical musical instrument construction.

A further advantage of the present invention is the opening up of the instruments sonic range via. the advantage of reduced losses and improved transference of sound.

Another advantage of the invention is the removal of the structural need, and sound dampening effect of internal braces on the sound plates of the instrument.

A further advantage of the present invention is an increase in efficiency of the transference of sound from the strings to the vibration plates of the instrument.

A further advantage of the present invention includes a more precise tuning of the instruments musical ratios to promote reinforcement, rather than cancellation of sound.

Another advantage of the invention is the reinforcement of sound without the creation of "wolf tones" or standing waves, internal to the instrument.

Another improvement of the present invention is the increased neck length available to the player, due to greater sound, and tone, from a smaller sound box.

A further advantage of the present invention is a clear distinguishing and delineation between aspects of the musical instrument which transfer sound energy, with less loss of said energies, and aspects of the instrument which more perfectly radiate sound.

DESCRIPTION OF THE PREFERRED EMBODIMENTS

Figure 1:
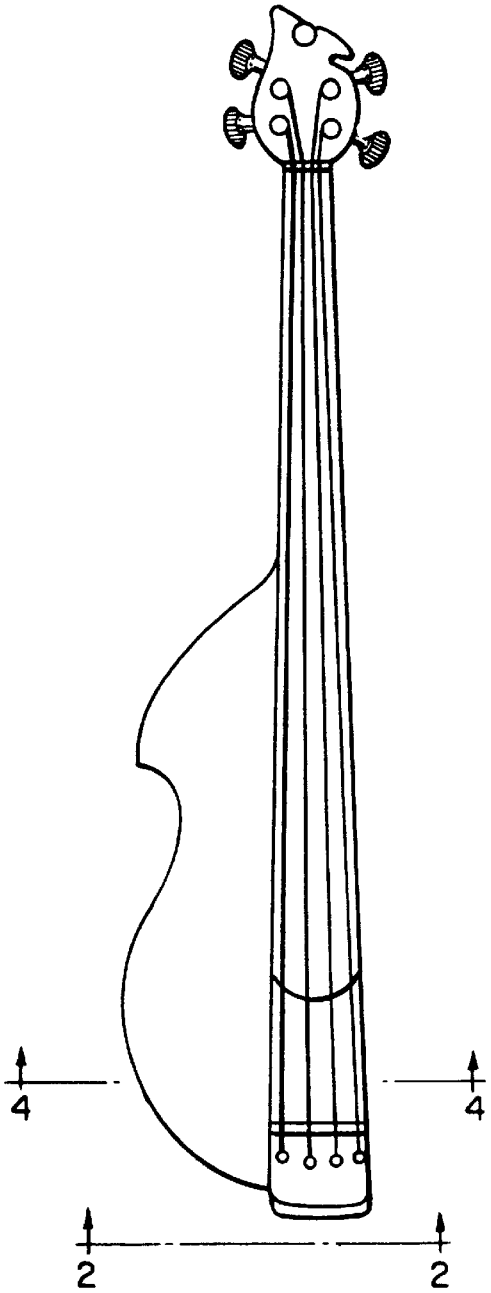
FIG. 1 is a front elevational view of a stringed musical instrument.
Figure 2:
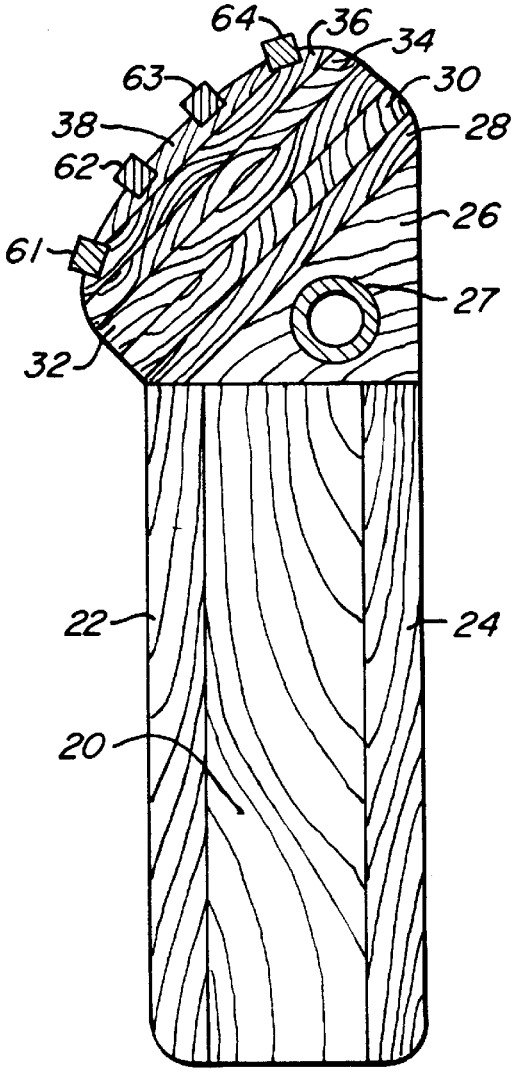
FIG. 2 is the bottom view of the portion indicated by section lines 2 in FIG. 1.

FIG. 1 is a front elevational view of a completed musical instrument. The portion indicated by section lines 2 in FIG. 1 is shown as a cross sectional view of the bottom of the instrument in FIG. 2. Part 22 represents the top plate of the instrument, and part 24 represents the instruments back plate. In the preferred embodiment of the invention, plates 22 and 24 are cut from the same piece of material, and realigned to help ensure structural stability and acoustic sympathy between the two plates. Side wall 20, represents the central structural member of the instrument. Part 26 acts to join the body section, (side wall 20 and parts 22, 24) to the neck sections of the instrument, parts 28, 30, 32, 34, 36, and 38. Part 26 also acts to angle the neck of the instrument with regard to the instruments body so as to emulate the depth and bulk of larger traditional instruments. Part 27 attaches to the traditional "end pin" which adjusts the instruments height to the performer. Parts 61, 62, 63, and 64, represent the bridge section, where the strings terminate. For a description of the construction of the neck of the instrument in the preferred embodiment see U.S. Pat. No. 5,445,058 Sep. 29, 1995, Hoke.

Figure 3:
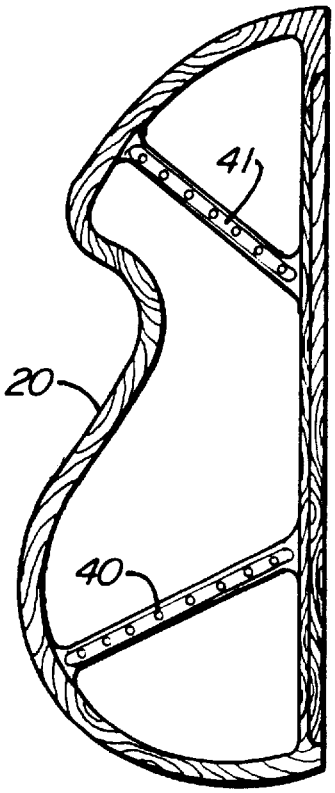
FIG. 3 is a front elevational view of the instruments central section, designated as part 20 in FIG. 2.

FIG. 3 is a front elevational view of the side wall 20. Parts 40, and 41 act to give side wall 20 extreme structural integrity, and minimal sound dampening from mass, or blockage of air flow in the resultant chamber created between parts 22 and 24. Parts 40 and 41 are designed for rigidity from resonant hardwood, selected for the purpose of transferring without loss, vibrations from the strings and neck sections of the instrument across 20, and then to the top and back plates of the instrument, 22 and 24 (and, or, other plates or vibrating membranes of said instrument). Parts 40 and 41 extend in a generally non parallel manner from the instruments neck and replace the sound posts required in traditional instruments.

Parts 40 and 41 are designed to supply strength and rigidity to the central section of the instrument to the extent that no further braces are required to maintain the integrity of plates 22 and 24. In the preferred embodiment of the design parts 40 and 41, are shaped to be tuned in a ⅓ octave manner for the back of the instrument, and a ⅔ octave manner for the top of the instrument as is commonly understood in the art.

Figure 4:
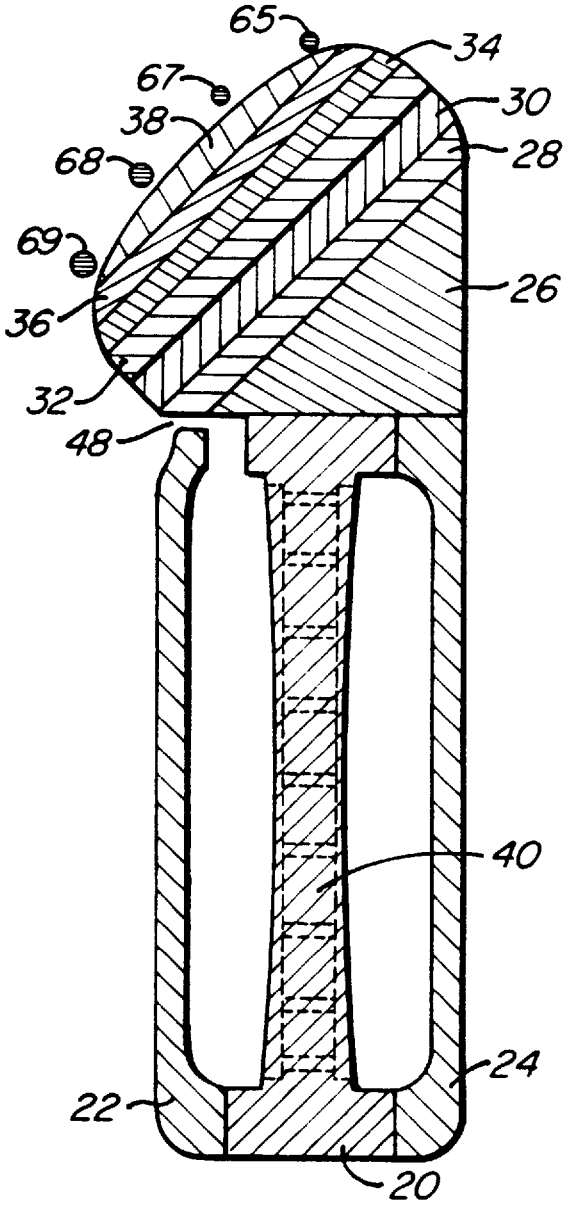
FIG. 4 is a cross sectional view of the portion indicated by the section lines 4 in FIG. 1.

FIG. 4 shows a cross sectional view as indicated by the section lines 4 in FIG. 1. This perspective of the instrument shows how parts 40 and 41 are shaped to maximize the air flow, and sound resonance around parts 40 and 41; as well as the direct transfer of vibrations through parts 40 and 41. Maximizing the rigidity to density ratio of parts 40 and 41 causes a more direct transfer of sound through parts 40 and 41 by minimizing losses of sound caused by improper phase losses, and structural dampening.

Parts 22, and 24 represent the top and back plates of the instrument respectively. In the preferred embodiment of the present invention parts 22, and 24 are shaped from a single piece of material. Parts 22, and 24 are hollowed out to the thickness appropriate for instrument tops and back plates, and as such, they represent an integral part of the sides of the instrument, side wall 20. It is of course possible to place an appropriately thickness prepared top and back plate directly on side wall 20, however, hollowing parts 22, and 24 creates greater stability in the resultant top and back plates.

In the preferred embodiment of the invention the top and back plates (22,24) are respectively tuned in a ⅓ octave, and ⅔ octave manner by means commonly understood in the art of plate turning. As parts 22, and 24, are cut from the same material and put back together without discrepancy, excluding the intervening presence of side wall 20, material sympathy is insured and due to the intervening rigidity of side wall 20, no braces are required on parts 22, and 24.

In FIG. 4 part 48 represents the instruments sound hole. Parts 65, 67, 68, and 69, represent a cross sectional view of the instruments strings.

Figure 5:
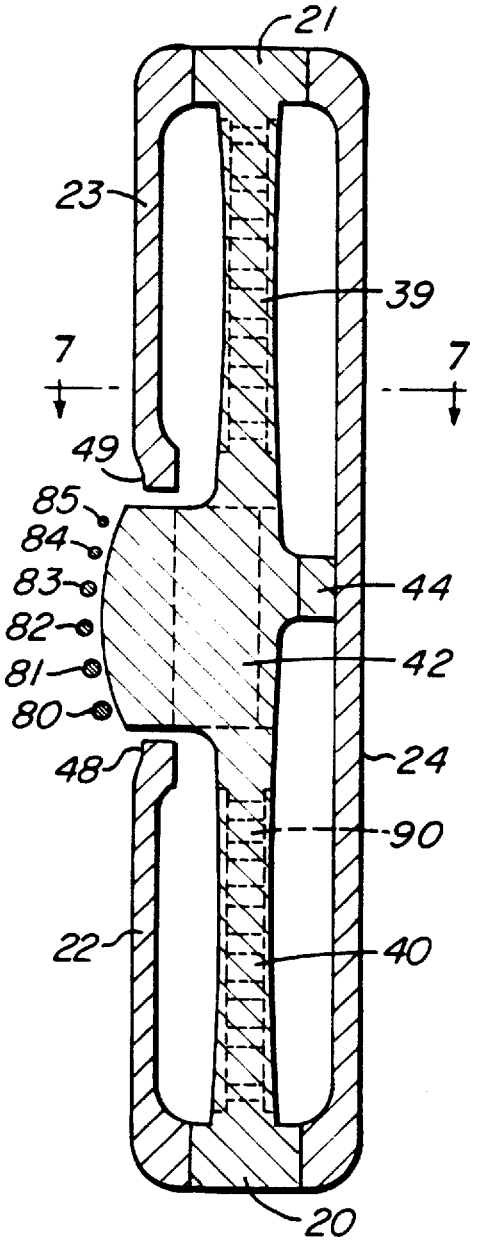
FIG. 5 is a similar cross sectional view employing modifications to create a different type of acoustic instrument.

FIG. 5 shows a cross sectional view similar to FIG. 5, wherein a variation of the present invention includes the duplication of the instruments body section on either side of said neck section 42. In this instance side wall 20 is duplicated as part 21, and part 22 is duplicated as part 23, also part 40 is mirror imaged with part 39. This variation may be used in the case of improving traditional instruments, such as violins, guitars, cellos, etc. The angle of the neck relative to the body may be adjusted per the requirements of the particular instrument, ie. angling the body sections downward to accommodate bowing on a violin.

Further variations include adjusting contact between the neck of the instrument and the instruments back plate by adjusting the size of part 44, or eliminating part 44 entirely, depending upon the particular instrument being produced, and the trade off between audio transfer to back plate 24 and the dampening that it produces upon said back plate.

Extensive variations of the invention are possible given the number of acoustic instruments that can be manufactured utilizing the present invention. Further variations may include expanding, contracting, reshaping, relocating or eliminating sound holes 48 and 49.

The degree of contact that the top and back plates 22, and 24, have with the rest of the instrument may be increased or reduced since the instrument maintains structural integrity with or without said plates. Hence, the amount of contact that the plates have in common with the rest of the musical instrument may be reduced to maximize free vibration of said transferred audio energies, or increased to create a greater resonance with the rest of the instrument.

Also of consideration is reshaping, and making side wall 20 thinner so that multiple central sections may be layered atop each other to create structurally stable labyrinths, with openings between each layer to provide resonance.

An advantage of channeling sound through internal baffles would include extending the length traveled by sound waves, so as to extend the instruments frequency range, and to enhance the ability of tuning said frequencies.

In FIG. 5 parts 80, 81, 82, 83, 84, and 85, represent a cross sectional view of the instruments strings.

Figure 6:
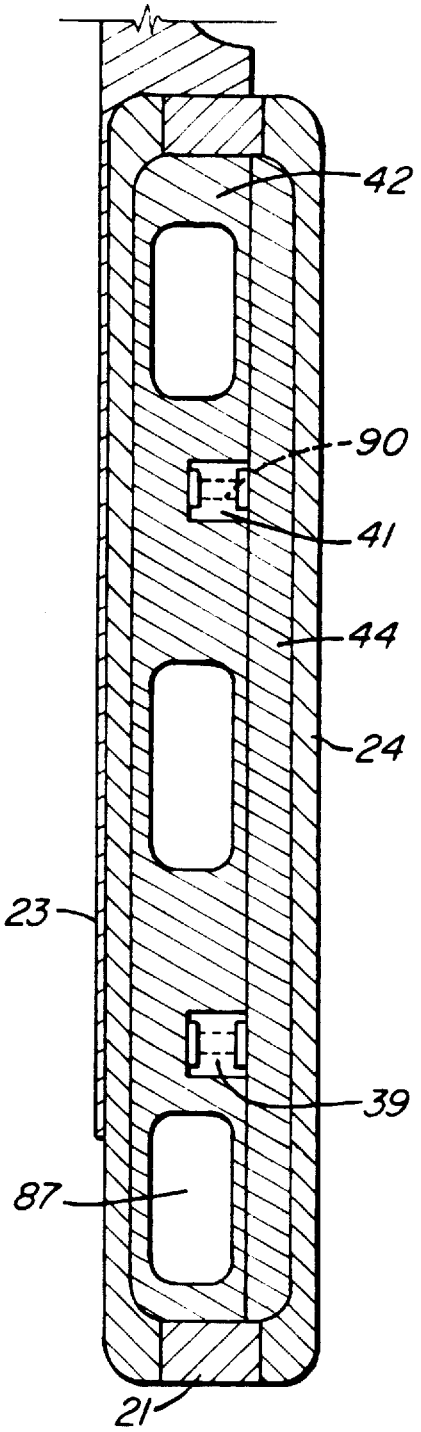
FIG. 6 is a 90 degree perspective view of the portion indicated by the section lines 7 in FIG. 5.

FIG. 6 is a perspective view as indicated by the section lines 7 in FIG. 5. This view shows how neck section 42 has been ported with openings 87 to allow the transfer of air between hemispheres of the instruments body, creating a single larger cavity in the body of the instrument.

In the preferred embodiment of the invention, parts 39, and 41, are generally "I" beam shaped with through holes, indicated as part 90.

In a traditional acoustic instrument braces exist between the instruments sides, and the top and back plates of the instrument. Additional braces are added directly to the top and back plates of the instrument. Since the top and back plates are usually approximately one eighth of an inch thick, they cannot withstand the forces exerted upon them by the tension of strings or the rigors of performance without braces. Also they would warp over time if braces were not present. When the acoustic energy of a vibrating string enters the body of a traditional instrument, said energies are transferred equally to the instruments braces, and the resonant top and back of the instrument, which is tuned to vibrate, and amplify the strings sound. The problem is that the braces of an instrument are not designed to actuate the strings energies as much as protect the instruments plates from internal and external stresses. Braces then act to dampen the vibrational plates of an instrument by reducing its ability to vibrate, and also by changing its vibrational patterns by creating vibrational modes. These modes may be extremely damaging as well in that they often act to cancel out the strings energies by being out of phase vibrationally.

In the present invention, the instruments structural system is designed to transfer directly, the energies of the instruments strings. Since parts 39, 40, and 41 are extremely rigid they are capable of transferring sound with minimal loss, and without introducing modal behavior that would be vibrationally out of phase, negating some of the strings energies.

Further, the present invention removes all structural considerations from the instruments top and back plates, leaving them to vibrate more freely, unhampered by modal behavior. The methods described herein render the top and back vibrational plates of any configuration of acoustic instrument stable with regard to internal and external forces over time. It should become clear to anyone versed in the art that the present invention represents the clearest delineation of sound transference vs. sound actuation; and or cancellation, for the acoustic instrument.

What I claim is:

1. A stringed musical instrument having a neck and at least one or more vibrational plates, and at least one string stretched along said neck, and further including:

at least one side wall having at least one end and one side, wherein said at least one end is connected to at least one vibrational plate and said one side is connected to an additional part which extends between said neck and said side wall of the instrument, substantially non parallel to said neck, whereby musical vibrations produced by said at least one string, are transmitted accurately from said neck to said side wall and to said at least one or more vibrational plates of the instrument, wherein said at least one vibrational plate is connected to said side wall, but is not directly connected to said additional part.

2. A stringed musical instrument according to claim 1, wherein:

said at least one vibrational plate carries no structural load.

3. A stringed musical instrument according to claim 1, wherein:

said additional part extending from said neck transfers acoustical energy and vibration without substantial loss or cancellation of musical accuracy, whereby such accurate transference of audio energy reduces dampening of said audio energy.

4. A stringed musical instrument according to claim 1, wherein:

a plurality of additional parts are connected to and extend between said neck, whereby musical vibrations produced by said at least one string, are transmitted accurately from said neck to said plurality of additional parts and to said at least one vibrational plate of the instrument.

5. A stringed musical instrument having a neck and at least one or more vibrational plates, and at least one string stretched along said neck, and further including:

at least one side wall having at least one end and one side, wherein said at least one end is connected to at least one vibrational plate and said one side is connected to an additional part which extends between said neck and said side wall of the instrument, substantially non parallel to said neck, whereby musical vibrations produced by said at least one string, are transmitted accurately from said neck to said side wall and to said at least one or more vibrational plate of the instrument, wherein said at least one vibrational plates is connected to said side wall, but is not directly connected to said additional part, wherein said additional part increases said instruments audio range and acoustical properties, and reinforces said at least one string's musical amplitude by elimination of internal braces attached directly to said at least one vibrational plate.

6. A stringed musical instrument having a neck and one or more vibrational plates, and at least one string stretched along said neck, and further including:

a side wall having multiple ends and multiple sides, wherein said multiple ends are connected to at least one or more vibrational plates and said multiple sides are connected to multiple additional parts extending between said neck and said side wall of said instrument, substantially non parallel to said neck, whereby musical vibrations produced by said at least one string, are transmitted accurately from said neck to said side wall and to said one or more vibrational plates of the instrument, wherein each additional part resides on a separate plane, tangential to each other, whereby the distance traveled by sound within said instrument is increased by being channeled across a substantial portion of each said additional part before progressing to each successive plane of said multiple additional parts; said at least one or more vibrational plates are connected to said side wall, but are not directly attached to said multiple additional parts.

* * * * *